US005373585A

United States Patent [19]

Wiggins

[11] Patent Number: 5,373,585

[45] Date of Patent: Dec. 20, 1994

[54] THERAPEUTIC GLOVE

[75] Inventor: John Wiggins, 115-48 132nd St., Ozone Park, N.Y. 11420

[73] Assignees: John Wiggins; Paul Wiggins; Mary Wiggins, all of Ozone Park, N.Y.; Samuel Midgette, Bronx, N.Y.

[21] Appl. No.: 2,649

[22] Filed: Jan. 11, 1993

[51] Int. Cl.[5] ..... A41D 19/00

[52] U.S. Cl. ..... 2/159; 2/163

[58] Field of Search ..... 2/159, 163, 161 A, 16, 2/160, 161.1, 161.6, 161.7

[56] References Cited

U.S. PATENT DOCUMENTS 4,146,935 4/1979 Hinton ..... 2/161 A
4,684,123 8/1987 Fabry .
4,751,749 6/1988 Cowhey ..... 2/161 A
4,766,612 8/1988 Patton, Sr. .
4,830,360 5/1989 Carr, Jr. ..... 272/67
4,881,275 11/1989 Cazares et al. ..... 2/163 X
5,067,175 11/1991 Gold .

FOREIGN PATENT DOCUMENTS 2237726 5/1991 United Kingdom ..... 2/159

*Primary Examiner*—Clifford D. Crowder
*Assistant Examiner*—Amy B. Vanatta
*Attorney, Agent, or Firm*—Collard & Roe

[57] ABSTRACT

A therapeutic glove for exercising the fingers of a hand includes a glove body having finger portions each with a tip, a ring surrounding the tip of each finger portion, an anchor rod for each finger portion, a channel below the surface of the glove body extending along the back of each finger portion from the ring to the anchor rod, and an elastic resistance band located in the channel and connecting together the ring and the anchor rod.

14 Claims, 1 Drawing Sheet

THERAPEUTIC GLOVE

BACKGROUND OF THE INVENTION

1. Field of the Invention

The present invention relates to a therapeutic glove for exercising the fingers of a hand, including a glove body having finger portions each with a tip, a ring surrounding the tip of each finger portion, an anchor rod for each finger portion, a channel below the surface of the glove body extending along the back of each finger portion from the ring to the anchor rod, and an elastic resistance band located in the channel and connecting together the ring and the anchor rod.

2. The Prior Art

The therapeutic glove for exercising the fingers of the hand is particularly useful for people who have suffered hand injuries, and need to perform therapeutic exercises to help build back the weak muscles of the fingers.

Most prior art therapeutic devices operate in the palm of the hand where a person either grips a spring-loaded pair of handles or squeezes some putty or a soft rubber object, such as a ball, in order to exercise the fingers. However, this can cause damage to the palm of the hand. In the past there have been attempts to solve this type of problem, and prior proposals are as follows.

The Fabry U.S. Pat. No. 4,684,123 discloses a weighted exercise glove garment having at least one pocket made of an elastic material positioned over the back of the wearer's hand. This elastic material can be stretched to snugly hold one or more objects such as weights.

The Patton U.S. Pat. No. 4,766,612 discloses a protective work glove which comprises a glove having finger- and hand-protective chambers insertable therein. Specifically, there is a flexible connector which connects together protective members, which members may be made of metal, plastic or any other lightweight stiff material, such as aluminum, PVC or a fiber-reinforced plastic. The flexible connector strip could be made of cloth or a plastic strip such as polyolefin, nylon or the like. A foam layer may be plastic or elastic foam having a good tear resistance.

The Gold U.S. Pat. No. 5,067,175 discloses a padded glove which selectively protects certain portions of the wearer's hand. There are padded chambers located along the back of the hand and extending from approximately the tips of the fingers across the back of the hand portion and down to the wrist seam. It is indicated that the padding is preferably a continuous strip of foam padding. It is stated that the padded chambers can be narrow padding and cover only a small portion of the fingers in the glove.

However, the Gold patent, which has various padded chambers along the back of the foam-padded finger portions of the glove, does not suggest having elastic bands to exercise the fingers for therapeutic effects. The Gold patent also does not indicate that the various padded chambers which are used to protect the wearer's hand have the type of resiliency needed to cause bent fingers to spring back and straighten out, nor does it disclose specific structure for affixing the bands to the back of the gloves, namely, the rings at the tip of the fingers and the attachment means at the back of the glove.

SUMMARY OF THE INVENTION

It is an object of the present invention to provide a therapeutic glove for exercising the fingers of a hand, including a glove body having finger portions each with a tip, a ring surrounding the tip of each finger portion, an anchor rod for each finger portion, a channel below the surface of the glove body extending along the back of each finger portion from the ring to the anchor rod, and an elastic resistance band located in the channel and connecting together the ring and the anchor rod.

This invention relates to a therapeutic glove for exercising the fingers of the hand. The glove is particularly useful for people who have suffered hand injuries and therefore must perform therapeutic exercises to help recondition the weak muscles of the fingers. Rubber bands are placed on the outer portion of the fingers of the glove so that when the hand is closed, the rubber bands stretch. When the rubber bands retract, the fingers are pulled up and are straightened out. The rubber bands are secured at the knuckle area of the glove, and at the tips of the fingers, and are sewed into channels in the gloves so that they do not splay apart as the hand is closed. The inventive device operates on the fingers from the outside of the palm, thereby preventing damage to the palm of the hand.

In addition, there is a heavy rubber ring around the tip of each finger of the glove. Additionally, there are rod-shaped means made from metal, ceramic or hard plastic at the knuckle portion of the glove upon which it is possible to anchor the heavy rubber band in order to hold it in position between the ring finger tip and the anchoring rod means at the knuckle portion of the glove.

The advantages of the present invention are as follows.

The therapeutic glove is designed to strengthen a person's hands, fingers, and forearms. This is a lightweight glove with a heavy rubber ring at the tip of each finger, and a strong elastic band down the back of each finger to a brace, where it anchors. It increases circulation in the hand to relieve swelling and aids against edemas. The movement of each finger helps strengthen weak muscles in the fingers and joints, and strengthens the muscles in the forearms as well, improving blood circulation. As blood circulation increases, all muscles located in the fingers, forearms, wrist, and joints of the hands are strengthened. It is directed toward a therapeutic healing of muscles, as well as strengthening these muscles, and therefore is also useful for arthritic hand therapy, for weak hands, fingers, and wrists. In addition to arthritic patients at home, the therapeutic glove can be used in hospitals or nursing homes, by athletes, and by persons who use their hands for their livelihood, such as keyboard operators and musicians, and for persons who have chronic pain from injuries, such as veterans.

In addition, the therapeutic glove is flexible, lightweight, and machine washable, and can be made of leather, cloth, or a combination thereof.

The present invention achieves these objects and advantages and is directed to a therapeutic glove for exercising the fingers of the hand, comprising a glove body having finger portions each with a tip, a ring surrounding the tip of each finger portion, an anchor rod for each finger portion, a channel below the surface of the glove body extending along the back of each finger portion from the ring to the anchor rod, and an elastic resistance band located in the channel and connecting together the ring and the anchor rod.

The above objects and advantages can be achieved according to the present invention by providing a therapeutic glove for exercising the fingers of the hand, comprising a glove body having a back adapted to overlie the back of the hand, a palm-covering portion for covering the palm of the hand, a front end comprising four separate finger portions into which a finger of the hand may be inserted, a thumb portion into which the thumb of the hand may be inserted, a rear opening for receiving the hand, and a middle part positioned between the front end and the rear opening for covering the knuckles of the hand. The glove includes each finger portion having a tip and the thumb portion having a tip, ring means for surrounding the tip of each finger portion and a ring means for surrounding the tip of the thumb portion, anchor rod means located in said middle part for each finger portion and for said thumb portion, channel means below the surface of the glove body and extending along the back of each finger portion from said ring means to said anchor rod means, extending along the back of the thumb portion from said ring means to said anchor rod means. The elastic resistance bands have a first and a second end located in said channel means connected at said first end to said ring means, and connected at said second end to said anchor rod means, whereby whenever the fingers and the thumb of the hand are closed, the elastic resistance bands are stretched, exerting a reverse counterforce, thus pulling the fingers and thumb back straight so as to open the hand, and aiding in exercising the fingers of the hand.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only and not as a definition of the limits of the invention.

In the drawing, the FIGURE shows a therapeutic glove according to the present invention.

DETAILED DESCRIPTION OF PREFERRED EMBODIMENTS

Figure 1:
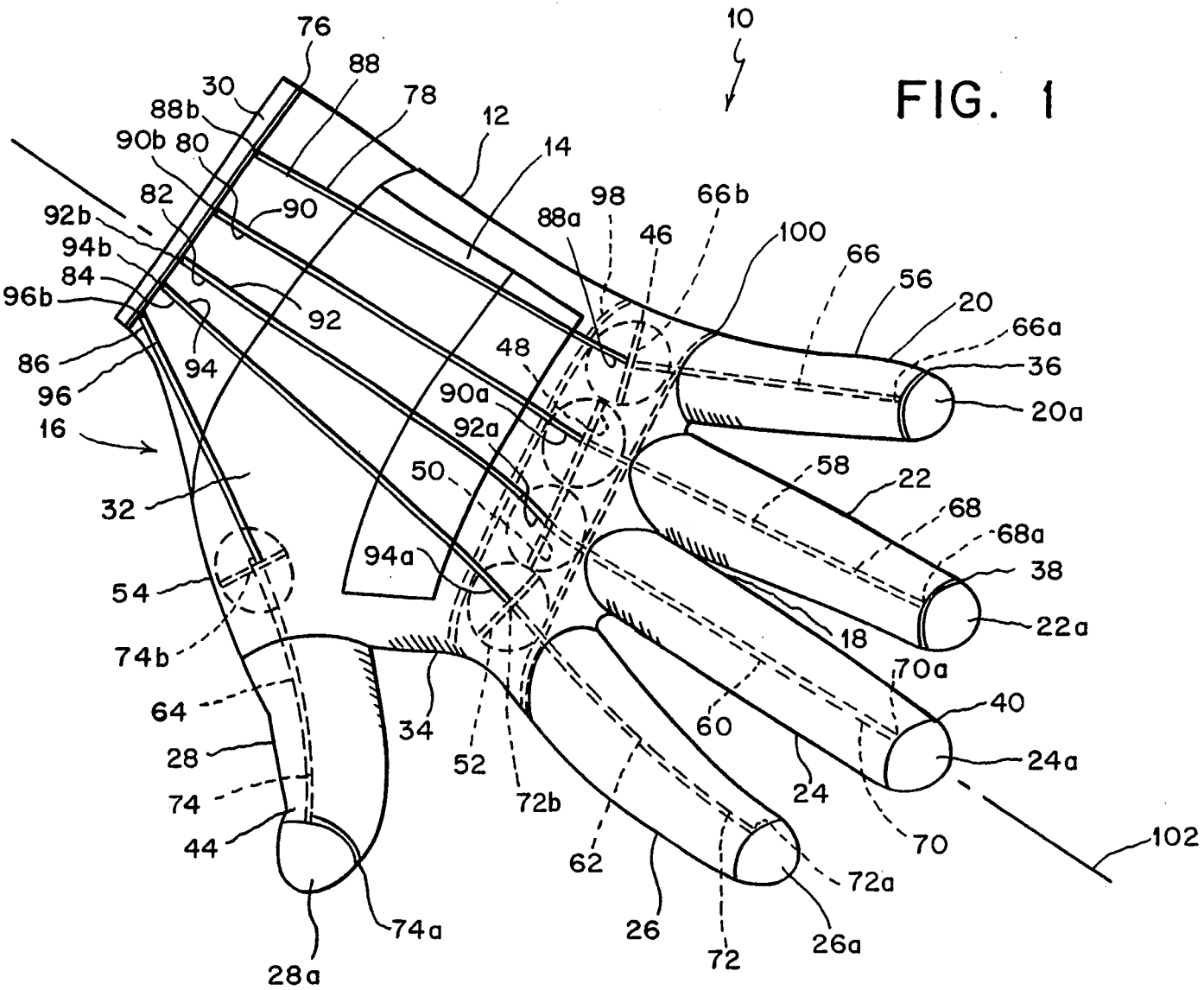

Turning now in detail to the drawing, the FIGURE shows a therapeutic glove 10 for exercising the fingers of the hand, including a glove body 12 having a back 14 adapted to overlie the back of the hand. There is included a palm-covering portion 16 for covering the palm of the hand, a front end 18 comprising four separate finger portions 20, 22, 24 and 26 into which a finger of the hand may be inserted, and a thumb portion 28 into which the thumb of the hand may be inserted. Rear opening 30 receives the hand, and a middle part 32 positioned between the front end 18 and the rear opening 30 covers the knuckles portion 34 of the hand.

Each finger portion 20, 22, 24 and 26 has a tip 20*a*, 22*a*, 24*a* and 26*a*, respectively, and the thumb portion 28 has a tip 28*a*. Ring means 36, 38, 40 and 42 surround the tip of each finger portion and ring means 44 surrounds the tip of the thumb portion, with anchor rod means 46, 48, 50 and 52 located in the middle part for each finger portion and anchor rod means 54 for the thumb portion.

Channel means 56, 58, 60 and 62 below the surface of the glove body extend along the back of each finger portion from the ring means 36, 38, 40 and 42 to the anchor rod means 46, 48, 50 and 52. Channel means 64 extends along the back of the thumb portion from the ring means 44 to the anchor means 54.

Elastic resistance bands 66, 68, 70, 72 and 74 each have a first end and a second end located in the channel means and are connected, respectively, at each of first ends 66*a*, 68*a*, 70*a*, 72*a*, and 74*a* to the ring means, and are connected at each of second ends 66*b*, 68*b*, 70*b*, 72*b*, and 74*b* to the anchor rod means. Therefore, whenever the fingers and the thumb of the hand are closed, the elastic resistance bands are stretched, exerting a reverse counterforce, pulling the fingers and thumb back straight so as to open the hand and aid in exercising the fingers of the hand.

The therapeutic glove also includes a top anchor perimeter rim means 76 for extending across the back of the glove adjacent to the rear opening 30. In addition, the therapeutic glove further includes a cavity means 78, 80, 82, 84 and 86 below the surface of the glove body extending along the back of the glove from each of the anchor rod means 46, 48, 50, 52 and 54 to the top anchor perimeter rim means 76.

Additionally, the therapeutic glove includes elastic resilient bands 88, 90, 92, 94, and 96 each having a first end 88*a*, 90*a*, 92*a*, 94*a*, and 96*a*, respectively; and a second end 88*b*, 90*b*, 92*b*, 94*b*, and 96*b*, respectively. These elastic resilient bands are located, respectively, within the cavity means 78, 80, 82, 84, and 86, and are connected at the first end 88*a*, 90*a*, 92*a*, 94*a*, and 96*a* to the anchor rod means 46, 48, 50, 52 and 54, respectively; and are connected at said second end 88*b*, 90*b*, 92*b*, 94*b*, and 96*b* to the top anchor perimeter rim means 76. The elastic resilient bands may be the same or different from the elastic resistance bands. Thus, the resilient bands may be made from the same material as the resistance bands. Also, these two bands may be two parts of the same continuous band, or they may be two separate and distinct bands.

First brace means 98 and second brace means 100 adjacent to the anchor rod means each provides lateral strength for the glove body. A ventilation opening is in the palm-covering portion of the glove body. The glove also includes a center-line longitudinal axis 102, wherein the first brace means 98 and the second brace means 100 are transverse braces extending perpendicular to the longitudinal axis and adjacent to the anchor rod means.

While only one embodiment of the present invention has been shown and described, it is to be understood that many changes and modifications may be made thereunto without departing from the spirit and scope of the invention as defined in the appended claims.

What is claimed is:

1. A therapeutic glove for exercising the fingers of the hand, comprising:

a glove body having a back adapted to overlie the back of the hand, a palm-covering portion for covering the palm of the hand, a front end comprising four separate finger portions into which a finger of the hand may be inserted and a thumb portion into which the thumb of the hand may be inserted, a rear opening for receiving the hand, and a middle part positioned between the front end and the rear opening for covering the knuckles of the hand;

each finger portion having a tip and the thumb portion having a tip;

ring means for surrounding the tip of each finger portion and a ring means for surrounding the tip of the thumb portion;

anchor rod means located in said middle part for each finger portion and for said thumb portion;

channel means below the surface of the glove body and extending along the back of each finger portion from said ring means to said anchor rod means and extending along the back of the thumb portion from said ring means to said anchor rod means;

elastic resistance bands having a first end and a second end and located in said channel means and connected at said first end to said ring means and connected at said second end to said anchor rod means;

brace means adjacent to said anchor rod means for providing lateral strength for said glove body;

a center line longitudinal axis;

said brace means being a transverse brace extending perpendicular to said longitudinal axis; and whereby whenever the fingers and the thumb of the hand are closed, the elastic resistance bands are stretched and exert a reverse counterforce tending to pull the fingers and the thumb back straight so as to open the hand, and aid in exercising the fingers of the hand.

2. The therapeutic glove of claim 1, further comprising a top anchor perimeter rim means for extending across the back of the glove adjacent to said rear opening.

3. The therapeutic glove of claim 2, further comprising a cavity means below the surface of the glove body and extending along the back of the glove from each of said anchor rods means to said top anchor perimeter rim means.

4. The therapeutic glove of claim 3, further comprising elastic resilient bands having a first end and a second end, said elastic resilient bands located in said cavity means and connected at said first end to said anchor rod means and connected at said second end to said top anchor perimeter rim means.

5. The therapeutic glove of claim 4, wherein said elastic resistance band and said elastic resilient band are each a part of the same continuous band.

6. The therapeutic glove of claim 4, wherein the elastic resistance band is separate and distinct from the elastic resilient band.

7. A therapeutic glove for exercising the fingers of the hand, comprising:

a glove body having finger portions each with a tip, said glove body having a rear opening;

a ring surrounding the tip of each finger portion;

an anchor rod for each finger portion;

a channel below the surface of the glove body extending along the back of each finger portion from the ring to the anchor rod;

an elastic resistance band located in the channel and connecting together the ring and the anchor rod;

a top anchor perimeter rim means for extending across the back of the glove adjacent to said rear opening;

brace means adjacent to said anchor rod means for providing lateral strength for said glove body;

a center line longitudinal axis; and said brace means being a transverse brace extending perpendicular to said longitudinal axis.

8. The therapeutic glove of claim 7, further comprising a cavity means below the surface of the glove body and extending along the back of the glove from each of said anchor rods to said top anchor perimeter rim means.

9. The therapeutic glove of claim 8, further comprising elastic resilient bands having a first end and a second end, said elastic resilient bands located in said cavity means and connected at said first end to said anchor rod means and connected at said second end to said top anchor perimeter rim means.

10. The therapeutic glove of claim 7, further comprising a ventilation opening in said palm-covering portion of said glove body.

11. The therapeutic glove of claim 9, wherein said elastic resistance band and said elastic resilient band are each a part of the same continuous band.

12. The therapeutic glove of claim 9, wherein the elastic resistance band is separate and distinct from the elastic resilient band.

13. A therapeutic glove for exercising the fingers of the hand, comprising:

a glove body having a back adapted to overlie the back of the hand, a palm-covering portion for covering the palm of the hand, a front end comprising four separate finger portions into which a finger of the hand may be inserted and a thumb portion into which the thumb of the hand may be inserted, a rear opening for receiving the hand, and a middle part positioned between the front end and the rear opening for covering the knuckles of the hand;

each finger portion having a tip and the thumb portion having a tip;

ring means for surrounding the tip of each finger portion and a ring means for surrounding the tip of the thumb portion;

anchor rod means located in said middle part for each finger portion and for said thumb portion;

channel means below the surface of the glove body and extending along the back of each finger portion from said ring means to said anchor means and extending along the back of the thumb portion from said ring means to said anchor rod means;

elastic resistance bands having a first end and a second end and located in said channel means and connected at said first end to said ring means and connected at said second end to said anchor rod means;

a top anchor perimeter rim means for extending across the back of the glove adjacent to said rear opening;

brace means adjacent to said anchor rod means for providing lateral strength for said glove body;

a center line longitudinal axis;

said brace means being a transverse brace extending perpendicular to said longitudinal axis; and whereby whenever the fingers and the thumb of the hand are closed, the elastic resistance bands are stretched and exert a reverse counterforce tending to pull the fingers and the thumb back straight so as to open the hand, and aid in exercising the fingers of the hand.

14. The therapeutic glove of claim 13, further comprising a cavity means below the surface of the glove body and extending along the back of the glove from each of said anchor rods means to said top anchor perimeter rim means;

elastic resilient bands having a first end and a second end; and said elastic resilient bands located in said cavity means and connected at said first end to said anchor rod means and connected at said second end to said top anchor perimeter means.

* * * * *